United States Patent [19]

Yasuoka et al.

[11] Patent Number: 4,819,596

[45] Date of Patent: Apr. 11, 1989

[54] METHOD FOR CONTROL OF IDLE ROTATIONS OF INTERNAL COMBUSTION ENGINE

[75] Inventors: Akimasa Yasuoka; Takeo Kiuchi; Takahiro Iwata, all of Tokyo, Japan

[73] Assignee: Honda Giken Kogyo Kabushiki Kaisha, Tokyo, Japan

[21] Appl. No.: 155,676

[22] Filed: Feb. 16, 1988

Related U.S. Application Data

[62] Division of Ser. No. 865,692, May 22, 1986, Pat. No. 4,760,823.

[30] Foreign Application Priority Data

Jun. 24, 1985 [JP] Japan ..... 60-137446
Jun. 24, 1985 [JP] Japan ..... 60-137447

[51] Int. Cl.[4] ..... F02D 41/16
[52] U.S. Cl. ..... 123/339; 74/860
[58] Field of Search ..... 123/339, 340; 74/873, 74/860

[56] References Cited

U.S. PATENT DOCUMENTS 4,237,833 12/1980 Des Lauriers ..... 123/339
4,305,360 12/1981 Meyer et al. ..... 123/339
4,344,399 8/1982 Matsumura et al. ..... 123/339
4,418,665 12/1983 Nagase ..... 123/339

*Primary Examiner*—Andrew M. Dolinar
*Attorney, Agent, or Firm*—Pollock, Vande Sande and Priddy

[57] ABSTRACT

An addition correction term is added to a feedback control term when an internal combustion engine is idling, a control valve is under feedback control, and an automatic transmission is in drive range (D range). The addition correction term is calculated by multiplying a predetermined constant value by at least one of several correction coefficients which are based on RPM and temperatures of the engine and vehicle speed. A learnt value is calculated based on intake manifold pressure when the internal combustion engine is in idling condition, the control valve is under feedback control, and the automatic transmission is in disengagement condition, for example, neutral range (N range). When the automatic transmission is turned into D range the existing manifold pressure is detected and the addition correction term is calculated based on the difference between the learnt value and the detected manifold pressure.

4 Claims, 9 Drawing Sheets

METHOD FOR CONTROL OF IDLE ROTATIONS OF INTERNAL COMBUSTION ENGINE

This is a divisional of application Ser. No. 865,692, filed on May 22, 1986, now U.S. Pat. No. 4,760,823.

BACKGROUND OF THE INVENTION (1) Field of the Invention

This invention relates to a method for controlling idling of speed of an internal combustion engine, and more particularly to such a method for the control of speed of idling rotations of an internal combustion engine, which effects feedback control of the idling speed of idling rotations of the internal combustion engine through control of the amount of inlet air to the internal combustion engine by means of a control valve disposed in a bypass interconnecting the upstream and downstream sides of a throttle valve inserted in an intake passage of the internal combustion engine.

(2) Description of the Prior Art

It has been customary to control the speed of idling rotations of an internal combustion engine through control of the amount of inlet air to the internal combustion engine by means of a control valve disposed in a bypass interconnecting the upstream and downstream sides of a throttle valve during a so-called idle operation or low-load operation, in which a throttle valve in an intake is kept in a substantially completely closed state.

In an automobile provided with an automatic transmission of fluid coupling, the load of the automatic transmission is exerted on the internal combustion engine while the automatic transmission is in its in-gear state, i.e. while the position of the selector is in its drive (D) range. It has been customary, therefore, to prevent the idling speed from dropping while the automatic transmission is in the drive (D) range by adjusting the inlet air control valve in its opening directions thereby increasing the amount of inlet air and enabling the mixture supplied into the engine to be increased.

It is generally known that in an internal combustion engine of the electronically controlled fuel injection type, an increase in the amount of inlet air results in a proportional increase in the amount of fuel to be injected and, consequently, in an increase in the amount of mixture.

The degree of opening of the control valve is controlled in a closed loop during an idling operation, i.e. while the throttle valve is substantially completely closed and the speed of engine rotations is in a prescribed range of idling rotations. An exciting current supplied to a solenoid proportionately controlling an opening angle of the control valve is fixed on the basis of a solenoid current command Icmd which is obtained in accordance with the following formula (1)

$$Icmd = Ifb(n) + Iat \quad (1)$$

wherein Ifb(n) denotes a PID feedback control term (basic control term) for effecting proportional (P term), integral control (I term), and derivative (D term) actions based on a deviation of the actual number of engine rotations Ne from the target number of idling rotations Nrefo and Iat denotes a correction term which is a constant Iato that is applicable while the automatic transmission is in D range.

As known well, the automatic transmission is provided with a pump impeller of a torque converter connected directly to the engine and a turbine runner connected directly to the output shaft, and the slip rate of the automatic transmission is fixed by the ratio of the rotational speed of the impeller and runner. In other words, the ratio between the speed of engine rotations and the speed of the automobile determines the slip rate.

During an idling operation, the slip rate reaches its maximum value when the automatic transmission is in the D range and the automobile is kept stopped by putting on the brakes.

When the automobile is travelling in a creep state or in the state of engine braking, the slip rate is lower than when the automobile is kept stopped by putting on its brakes. As a result in such an operating state the external load on the engine generated by the automatic transmission (hereinafter referred to as "AT load") is lowered, too.

The addition correction term Iat of the formula (1) mentioned above is generally fixed at a prescribed value Iato which permits correction of the AT load enough to prevent a decrease in the speed of idling rotations when the engine is kept in an idle operation after the warming of an engine has been completed and the speed of the automobile is still zero.

When the AT load is small as described above, or the automobile is travelling in the creep state or in the state of engine braking, the magnitude of the addition correction term Iat turns out to be too large for the actual magnitude of AT load. This trend becomes conspicuous particularly when the speed of engine rotations approaches the lower limit of the prescribed range of speed of idling rotations.

As a result, the magnitude of the feedback control term Ifb(n) for adjustment to the target number of idling rotations, Nrefo, is decreased.

Where the magnitude of the feedback control term Ifb(n) is set at a small level as described above, a sudden application of the brakes during the travel of the automobile in the creep state or in the state of engine deceleration results in a sharp increase in the AT load. There ensues a disadvantage that the decrease in the speed of engine rotations due to the increase in the AT load can no longer be corrected by the feedback control term Ifb(n) and the number of engine rotations is greatly decreased or the engine stalls.

The magnitude of the feedback control term Ifb(n) is also decreased when the state of engine braking is started while the automobile is travelling on a descending slope to lower the speed of the automobile from the state of high-speed operation until the number of engine rotations falls within the range of numbers of idling rotations and the operation of the control valve is shifted to the feedback control mode. When the vehicle brakes are suddenly applied in this case as in the case mentioned above, the number of engine rotations is greatly decreased or the engine stalls.

The PID coefficient (proportional, integral, and derivative control action gain) in the feedback control term Ifb(n) in the formula (1) is generally set at a small level. As the result, the feedback control by this term Ifb(n) is generally carried out slowly. This is because the stability of the stationary idle operation is impaired when the control gain is increased to increase the magnitude of feedback control.

SUMMARY OF THE INVENTION

An object of this invention is to provide a method for controlling the idling speed of an internal combustion engine without heavily dropping the speed of engine rotations or inducing engine stall even when the magnitude of AT load is suddenly changed (particularly suddenly increased).

To attain the object described above, this invention is characterized firstly by (1) establishing correction coefficients that are severally based on vehicle speed, the number of engine rotations, and the temperature of the cooling water (engine temperature) and (2) multiplying the prescribed constant value Iato of the addition correction term by at least one of these correction coefficients.

This invention is characterized secondly by (3) learning the internal pressure (intake manifold depression) in the intake manifold on the downstream side of the throttle valve and calculating the learnt value Pbref, while the internal combustion engine and consequently the control valve are undergoing feedback control in the idle operation state and, at the same time, the automatic transmission is in the neutral (N) range (no-load state), for example and (4), when the internal combusion engine is in the state mentioned in (3) above and the automatic transmission has reached the D range (load state), detecting the intake manifold depression Pba existing at that time and fixing the addition correction term Iat of the formula (1) based on the difference between the detected value Pba(n) and the learnt value Pbref calculated in (3) above.

In other words, this invention is characterized by causing the addition correction term Iat while the control valve is undergoing feedback control during the idle operation, to be set at an adequate value for the state of AT load existing at that time thereby stabilizing (particularly preventing excessive decrease) of the value of the feedback control term Ifb(n) without reference to possible variation of the AT load, thereby preventing the number of engine rotations from being greatly decreased or the engine from being brought into the state of stall even when the magnitude of the AT load is suddenly increased.

DETAILED DESCRIPTION OF THE PREFERRED EMBODIMENTS

Figure 2:
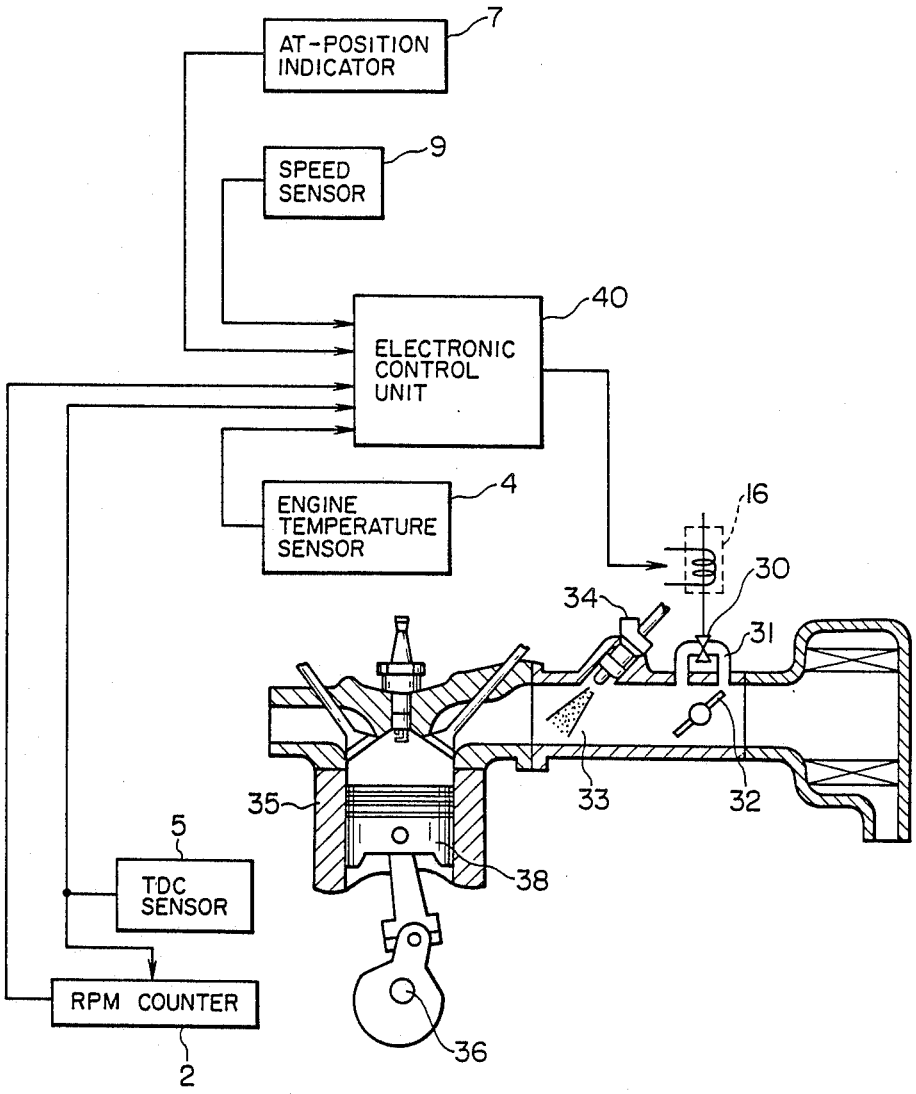
FIG. 2 is a schematic structural diagram of an apparatus for controlling the idling speed of an internal combustion engine, in accordance with the first embodiment of this invention.

Now, the present invention will be described in detail with reference to the accompanying drawings. FIG. 2 is a schematic structural diagram of an apparatus for controlling the idling speed of an internal combustion engine, in accordance with the first embodiment of this invention.

With reference to the diagram when the engine is idling the amount of inlet air in an intake manifold 33 having a throttle valve 32 in a substantially completely closed state is controlled by a control valve 30 disposed in a bypass passage 31 interconnecting the upstream and downstream sides of the throttle valve 32. The degree of opening of this control valve 30 depends on the magnitude of an electric current flowing through a solenoid 16.

The amount of the fuel injected through an injection nozzle 34 is fixed by conventional means in accordance with the amount of inlet air in the intake manifold 33. A piston 38 inside a cylinder 35 repeats a reciprocating motion to rotate a crank shaft 36.

A TDC sensor 5 generates a pulse each time the piston in each cylinder reaches 90 degrees before the top dead center. In other words, the TDC sensor 5 issues the same number of pulses (hereinafter referred to as "TDC pulses") as the number of cylinders each time the crank shaft 36 makes two rotations, and feeds the pulses to an electronic control unit 40.

An engine rotation (RPM) counter 2 senses the number of engine rotations by clocking the intervals in the TDC pulses fed out by the TDC sensor 5, issues a corresponding RPM digital signal, and feeds it to the electronic control unit 40.

An engine temperature sensor 4 detects the temperature of the engine cooling water, issues a corresponding engine temperature signal in the form of a digital signal, and feeds it to the electronic control unit 40.

An AT position indicator 7 feeds t the electronic control unit 40 a D range detection signal when the selector position of the automatic transmission is in the drive range, or it supplies unit 40 with an N range detection signal when the selector position is in the neutral range.

A speed sensor 9 detects the vehicle speed and feeds a corresponding digital speed signal to the electronic control unit 40. The electronic control unit 40 controls the electric current flowing through the solenoid 16 in the manner to be described afterward.

Figure 3:
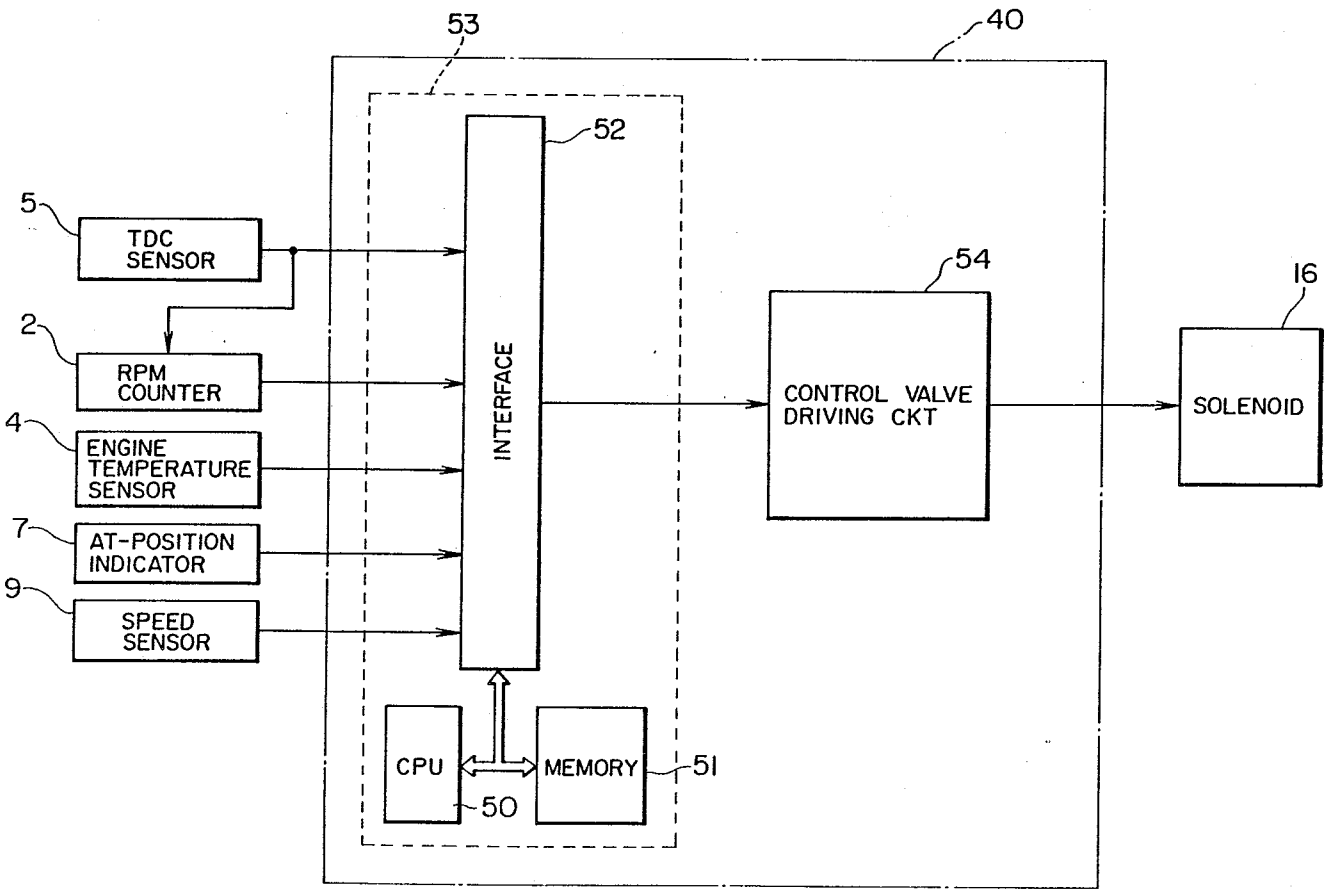
FIG. 3 is a block diagram illustrating a typical detailed structure of the electronic control apparatus of FIG. 2.

FIG. 3 is a block diagram illustrating a typical detailed structure of the electronic control unit 40 of FIG. 2.

The electronic control unit 40 comprises a microcomputer 53 composed of a central processing unit (CPU) 50, a memory 51, and an interface 52, and a control valve driving circuit 54 controls the electric current flowing through the solenoid 16 in compliance with a command (value of solenoid current command Icmd) from the microcomputer 53.

The control valve driving circuit 54 issues a control signal for controlling the electric current flowing through the solenoid 16 in accordance with the command Icmd. As the result, the degree of opening of the control valve 30 (FIG. 2) is controlled in accordance with the command Icmd and, consequently, the speed of idling rotations is controlled in accordance with the command Icmd.

Figure 1:
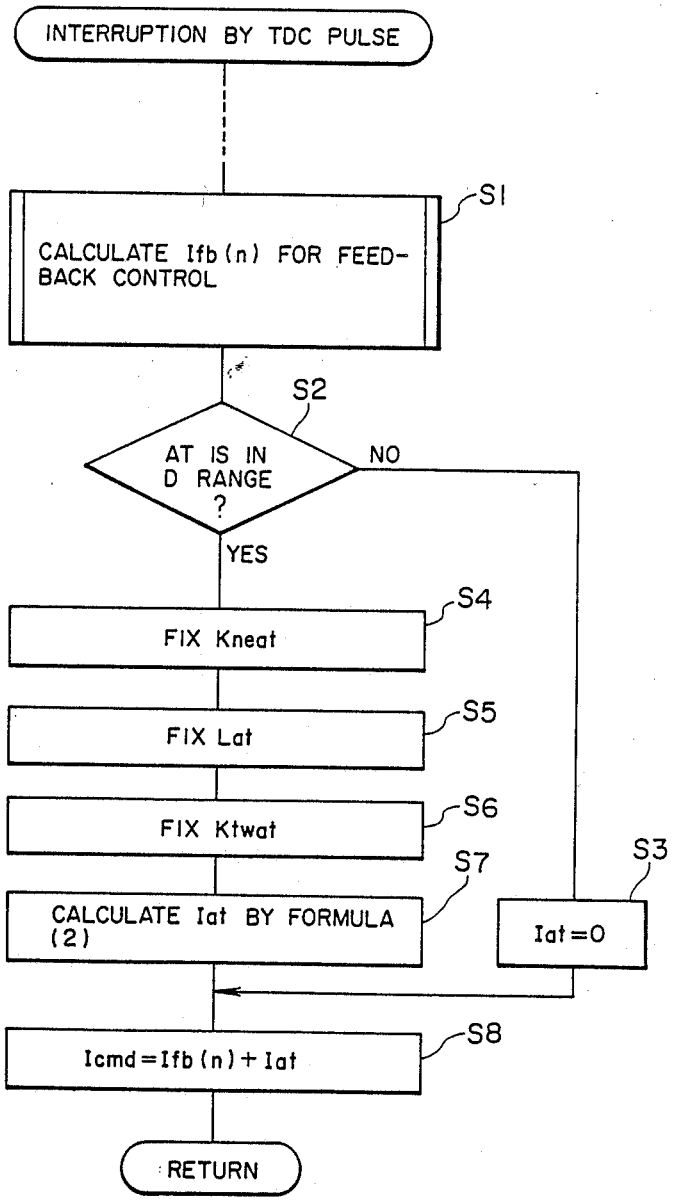
FIG. 1 is a flow chart for explaining the operation of the first embodiment of the present invention.

FIG. 1 is a flow chart for explaining the operation of one preferred embodiment of this invention. The operation illustrated by this flow chart is started by the interruption of a TDC pulse. The processing (which directly bears on the present embodiment) will be described hereinbelow solely on the assumption that the throttle valve is in a substantially completely closed state, the speed of rotations is in the prescribed range of speed of idling rotations, and the engine is operating in the feedback control mode.

Figure 7:
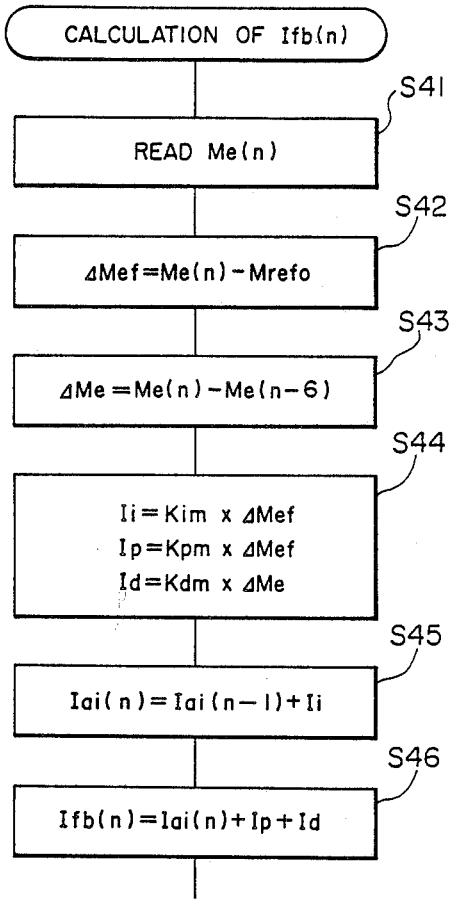
FIG. 7 is a flow chart showing the contents of the arithmetic operation in Step S1 of FIG. 1.

Step S1—This step calculates the value of Ifb(n) based on the arithmetic operation in the feedback control as explained afterward with respect to FIG. 7.

Step S2—This step determines whether the automatic transmission is in the D range or in the N range, in accordance with the output of the AT position indicator 7. The processing proceeds to Step S4 when the D range is indicated or to Step S3 when the N range is indicated.

Step S3—This step sets the value of the addition correction term lat in the formula (1) at 0. Then, the processing proceeds to Step S8.

Step S4—This step detects the current rotational speed Ne from the input signal to the RPM counter 2 and, based on the RPM, Ne, looks up the Ne~Kneat table stored in advance in the memory 51. As the result, the first correction coefficient Kneat is fixed.

Figure 4:
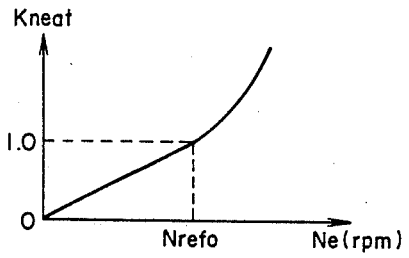
FIG. 4 is a graph showing a typical relation between the number of engine rotations Ne and the first correction coefficient Kneat.

FIG. 4 is a graph showing the relation between the number of rotations Ne and the first correction coefficient Kneat.

As noted from FIG. 4, this coefficient Kneat is "1.0" under standard operating conditions of the engine, i.e., when the number of rotations equals the target number of idling rotations Nrefo, proportionately decreases as the speed of rotation decreases from the number Nrefo, and proportionately increases as the number of rotations increases from the number Nrefo.

The coefficient Kneat is an empirical value of correction for the constant value Iato required in preventing the value of the feedback control term Ifb(n) from being varied even when the speed of idling rotations is raised or lowered with reference to the value of the feedback control term Ifb(n) existing when the engine is in a braked state, namely the vehicle speed is 0, the engine warming has been completed and the hydraulic oil of the automatic transmission has reached a stabilized state, and the speed of rotations equals the target number of idling rotations Nrefo.

Step S5—This step detects the existing vehicle speed, V, from the input signal to the speed sensor 9 and, based on the vehicle speed V, looks up the V~Lat table stored in advance in the memory 51. As the result, the second correction coefficient Lat is fixed.

Figure 5:
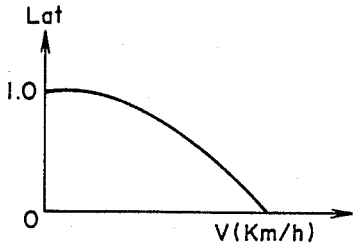
FIG. 5 is a graph showing a typical relation between the vehicle speed V and the second correction coefficient Lat.

FIG. 5 is a graph showing the relation between the vehicle speed V and the second correction coefficient Lat. This coefficient Lat as noted from FIG. 5, is "1.0" when the vehicle speed is 0 and approaches "0" in proportion as the vehicle speed rises.

The coefficient Lat is an empirical value of correction for the constant value Iato required in preventing the value of the feedback control term Ifb(n) from being varied even when the vehicle speed V is raised with reference to the value of the feedback control term, Ifb(n) existing when the number of rotations equals the target number of idling rotations, the engine warming has been completed and the hydraulic oil of the automatic transmission has reached a stabilized state, and the vehicle speed is 0.

Step S6—This step detects the existing engine temperature Tw from the output signal of the temperature sensor 4 and, based on the temperature Tw, looks up the Tw~Ktwat table stored in advance in the memory 51. As the result, the third correction coefficient Ktwat is fixed.

Figure 6:
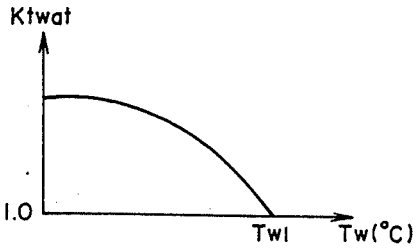
FIG. 6 is a graph showing a typical relation between the engine temperature Tw and the third correction coefficient Ktwat.

FIG. 6 is a graph showing the relation between the temperature Tw and the third correction coefficient Ktwat. This coefficient Ktwat, as noted from FIG. 6, is "1.0" under standard operating conditions of the engine, i.e., when the temperature exceeds the temperature Tw1 after completion of the engine warming, and increases in proportion as the temperature falls below the temperature Tw1.

This coefficient Ktwat is an empirical value of correction for the constant value Iato required in preventing the value of the feedback control term Ifb(n) from being varied even when the temperature Tw is lowered from the temperature Tw1 after completion of the engine warming with reference to the value of the feedback control term Ifb(n) existing when the vehicle speed is 0, the number of rotations is set at the target number of idling rotations, the engine warming has been completed, and the hydraulic oil of the automatic transmission has reached a stabilized state.

Step S7—This step calculates the addition correction coefficient Iat of the formula (1), based on the following formula (2).

$$Iat = Iato \times Kneat \times Lat \times Ktwat \quad (2)$$

It is noted from the formula (2), the present embodiment corrects the constant correction term Iato existing so far when the automatic transmission is in the D range by multiplying this term by the coefficients Kneat, Lat and Ktwat, and adopts the product of the formula (2) as a new correction term Iat. The value of Iato is a constant stored in advance in the memory 51.

The processing has been described as effecting the correction by multiplying the constant value Iato by all three correction coefficients Kneat, Lat, and Ktwat. This invention does not require the correction to be made invariably in this manner. For example, by multiplying the constant value Iato by one or two of the three correction coefficients Kneat, Lat, and Ktwat, the value of Iat can be approximated to an adequate value conforming to the actual AT load.

Step S8—This step adds the value of Iat set in Step S3 or Step S7 to the value of Ifb(n) calculated in Step S1 and issues the sum as a solenoid current command Icmd to the control valve driving circuit 54.

Then, the processing returns to the main program. As the result, the control valve 30 (FIG. 2) has the degree of its opening controlled by the control valve driving circuit 54 and the solenoid 16 in accordance with the command Icmd.

FIG. 7 is a flow chart showing the detail of the arithmetic operation performed in Step S1 of FIG. 1.

Step S41—This step reads in the reciprocal (period) of the number of rotations detected by the RPM counter 2 or an equivalent value, Me(n) (wherein n denotes the current speed of detection).

Step S42—This step calculates the deviation ΔMef of the value Me(n) read in as described above from the reciprocal or period of the target number Nrefo of idling rotations or an equivalent value Mrefo set in advance.

Step S43—This step calculates the difference between the value Me(n) mentioned above and the value Me measured in the previous cycle in the same cylinder as the value Me(n) was detected [Me(n−6) where the engine is a 6-cylinder engine], i.e. the rate of change ΔMe of the period.

Step S44—This step calculates the integration term Ii, the proportional term Ip, and the derivative term Id by using the values ΔMe and ΔMef mentioned above, and the integration term control gain Kim, the proportional term control gain Kpm, and the derivative term gain Kdm, in accordance with the formulas of arithmetic operation shown in the diagrams. The various control gains mentioned above have been stored in the memory 51 in advance.

Step S45—This step effects the calculation of the value Iai(n) by adding the integral term Ii obtained in Step S44 to the value Iai (value in the previous cycle: n−1). To be used as the value Iai(n−1) in the next cycle, the value Iai(n) obtained in this step is temporarily stored in the memory 51. When the memory 51 has not yet stored any actual Iai data, it suffices to have a numerical value resembling Iai stored in advance in the memory and to read out this numerical value as Iai(n−1).

Step S46—This step defines the value of Ifb(n) by adding the values of Ip and Id calculated in Step S44 to the value of Iai(n) calculated in Step S45.

As is clear from the foregoing description, the first embodiment of the invention, when the internal combustion engine is in the process of an idle operation under feedback control and the automatic transmission is in the D range, determines the correction coefficients based on the vehicle speed, the rotational speed of the engine, and the engine temperature and then fixes the addition correction term lat in the formula (1) by multiplying the prescribed value Iato, required to be added when the automatic transmission is in the D range, by at least one of the correction coefficients mentioned above.

As the result, the addition correction term lat is made an adequate value and the value of the feedback control term Ifb(n) of the formula (1) is stabilized and is relieved of the possibility of decreasing to an excessive extent.

Figure 8:
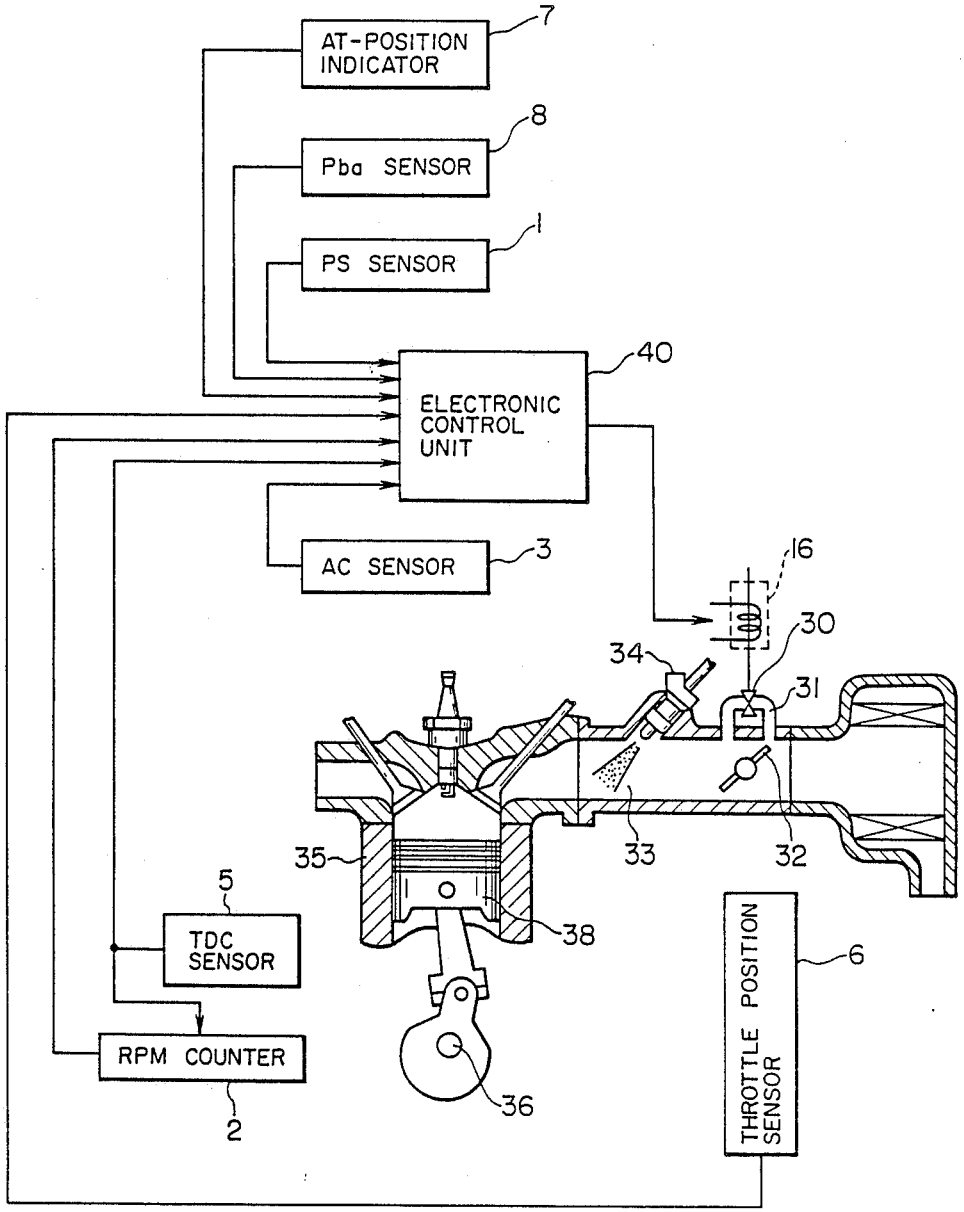
FIG. 8 is a schematic structural diagram of an apparatus for controlling the idling speed of an internal combustion engine, in accordance with a second embodiment of this invention.

FIG. 8 is a schematic structural diagram of an apparatus for controlling the idling speed of an internal combustion engine, in accordance with the second embodiment of this invention. The control apparatus of FIG. 8 is equivalent to the control apparatus of FIG. 2 plus a power steering sensor 1, an air conditioner sensor 3, a throttle position sensor 6, and an intake manifold pressure sensor 8 and minus an engine temperature sensor 4 and a speed sensor 9.

The air conditioner sensor (AC sensor) 3 feeds an air-conditioner operation signal to the electronic control unit 40 when the compressor of the air conditioner is in engagement with the engine. The throttle position sensor 6 feeds a digital signal representing the position of the throttle valve 32 to the electronic control unit 40.

The intake manifold pressure sensor ( Pba sensor 8 detects the absolute pressure inside the intake manifold on the downstream side of the throttle valve 32 and feeds a corresponding digital signal representing intake manifold pressure to the electronic control unit 40.

The power steering sensor (PS sensor) 1 feeds a power steering operation signal to the electronic control unit 40 when the power steering is operating. The power steering operation signal may be a digital signal indicative of the angle of steering corresponding to the angle of the steering wheel.

Figure 9:
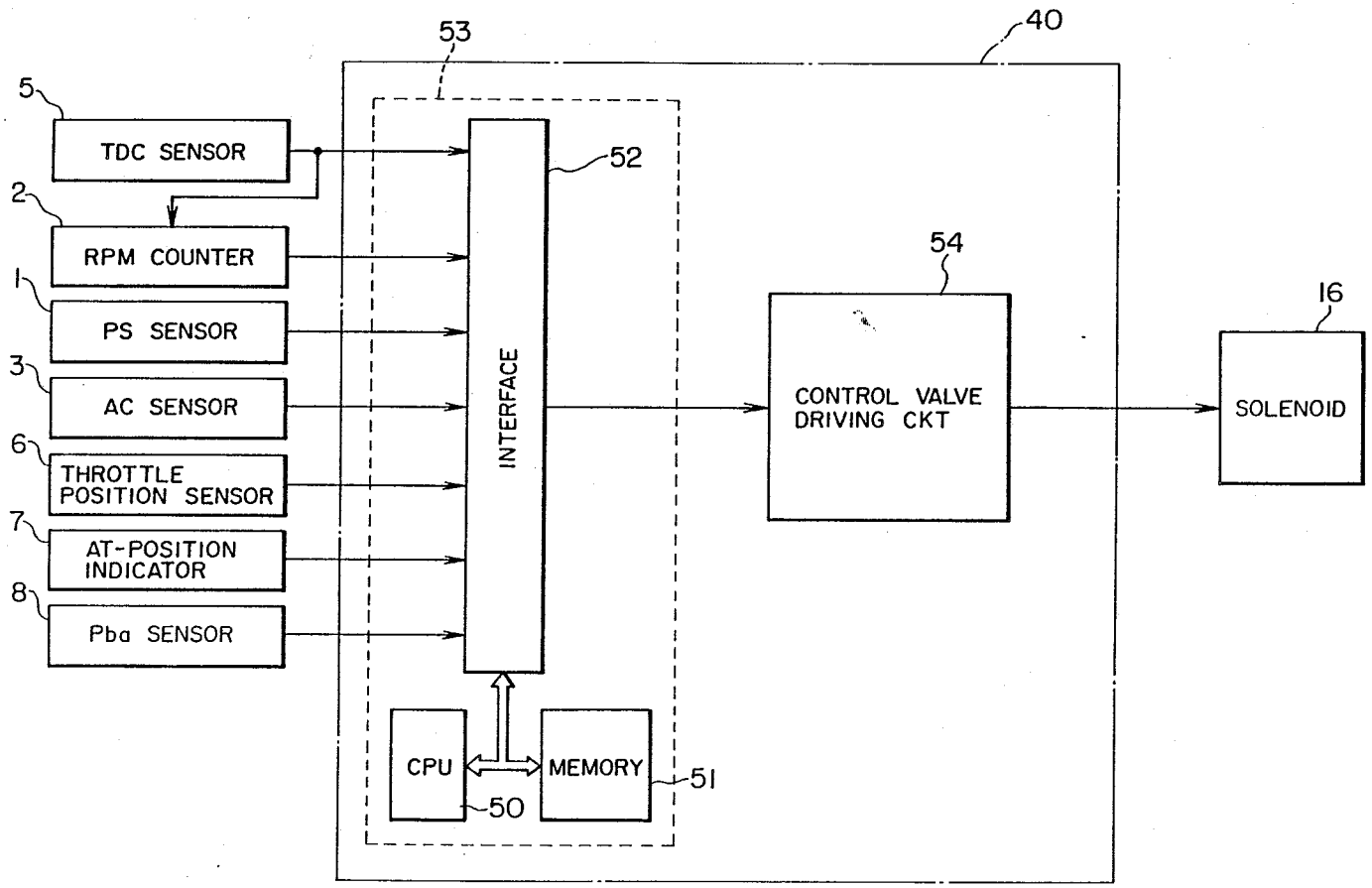
FIG. 9 is a circuit diagram illustrating a typical detailed structure of the electronic control apparatus of FIG. 8.

The electronic control unit 40 controls the electric current flowing through the solenoid 16 in a manner to be described afterward. FIG. 9 is a circuit diagram illustrating a typical internal structure of the electronic control unit 40 of FIG. 8. In the diagram, parts equal or similar to those found in FIG. 3 are designated by the same reference numerals.

Figure 10A:
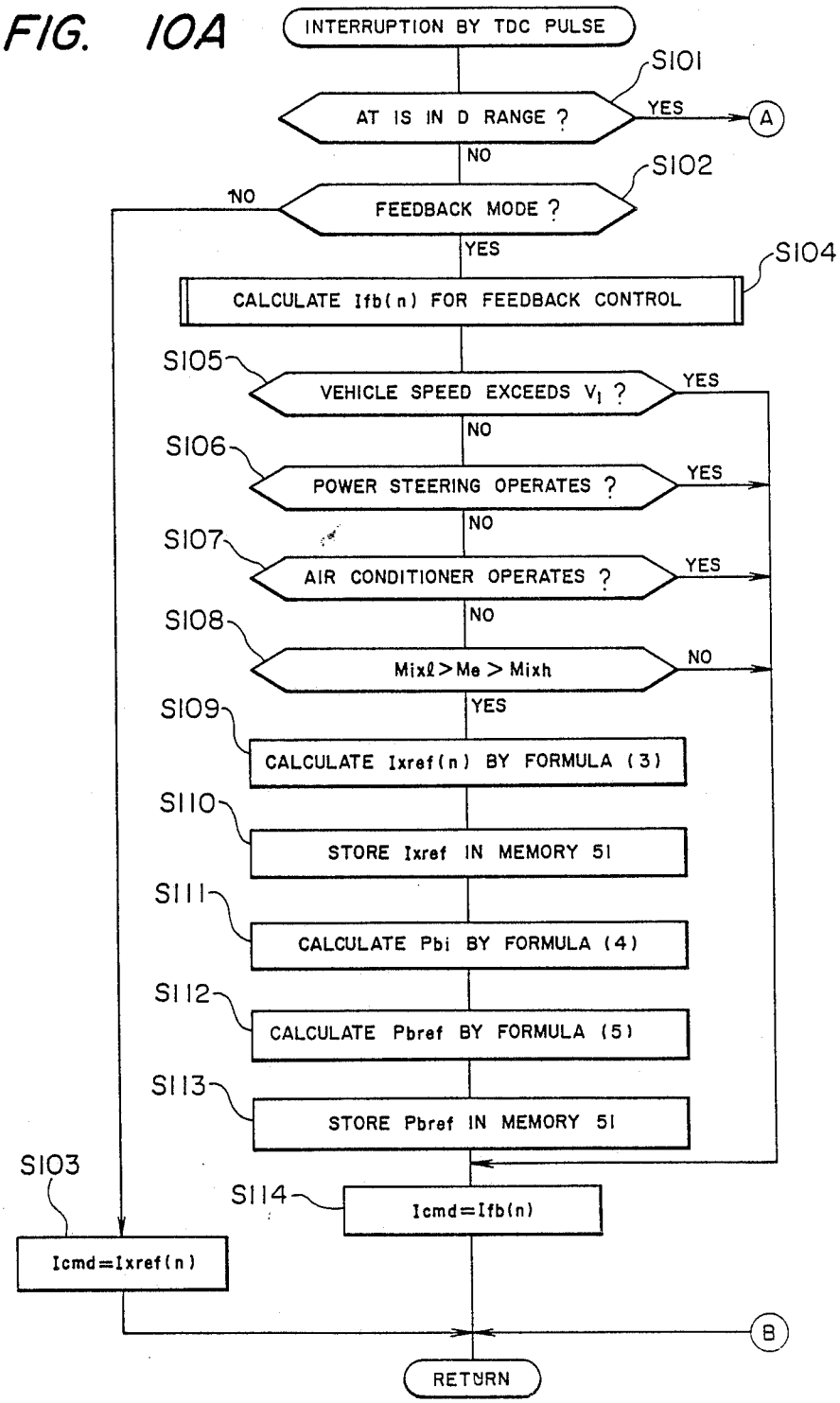
FIGS. 10A and 10B are flow charts for explaining the operation of the second embodiment of this invention.
Figure 10B:
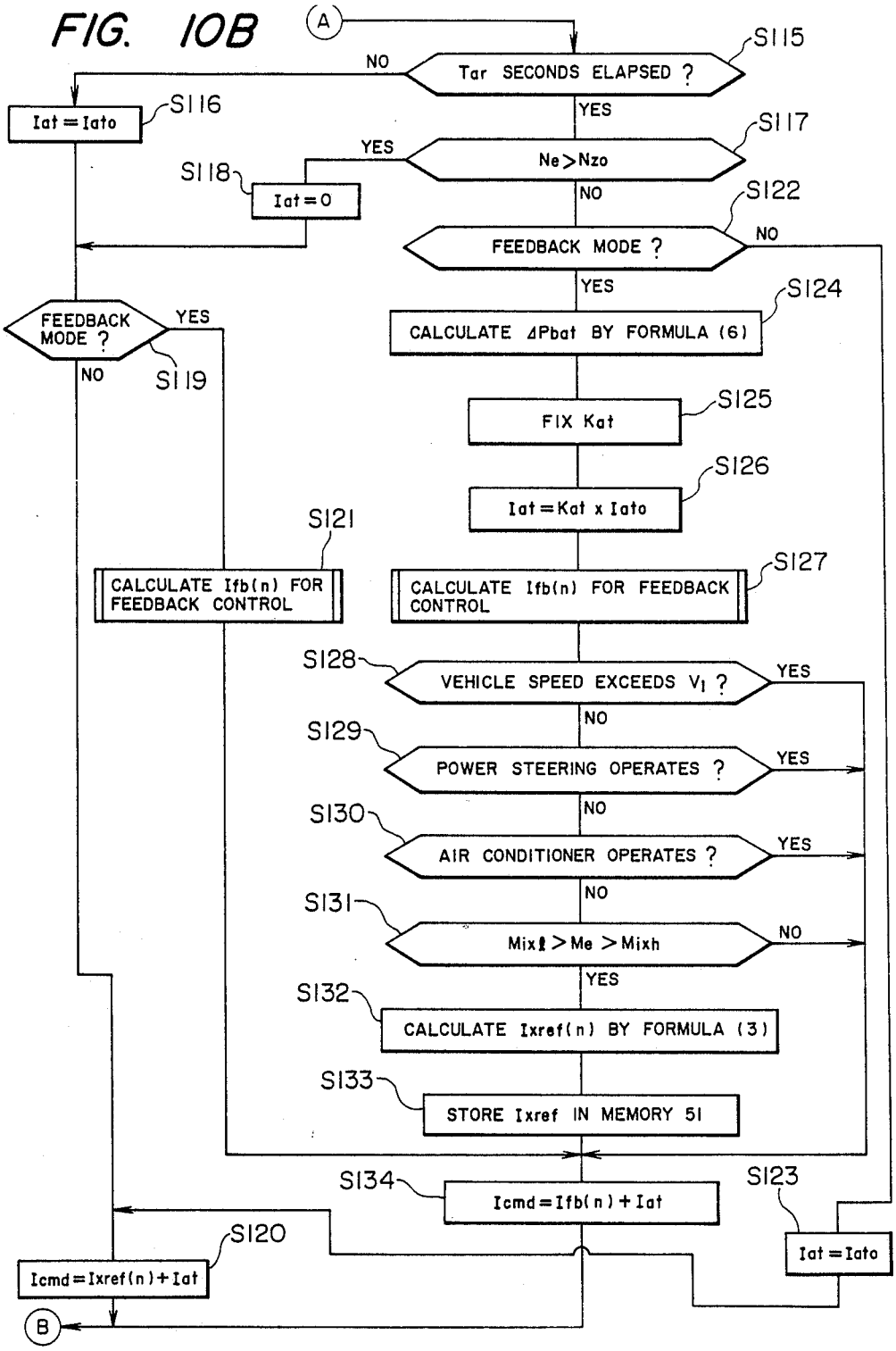

FIG. 10 is a flow chart for explaining the operation of the second embodiment of the present invention. The operation depicted by the flow chart of FIG. 10 is started by the interruption of a TDC pulse.

Step S101—This step determines whether the automatic transmission is in the D range or in the N range in accordance with the output of the AT position indicator 7. The processing proceeds to Step 115 when the D range is indicated or to Step 102 when the N range is indicated.

Step S102—This step determines whether the control valve 30 (FIG. 8) is in the feedback control mode or not. To be specific, this step confirms the existence of the feedback mode and advances the processing to Step S104 when it judges that the throttle valve 32 (FIG. 8) is in a substantially completely closed state in accordance with the input signal from the throttle position sensor 6 and that the number of rotations is in the prescribed range of idling speed in accordance with the input signal from the RPM counter 2. Otherwise, the processing proceeds to Step S103.

Step S103—This step looks up the learnt value Ixref(n)(wherein n denotes the current value) calculated in Step S109 or Step S132 as described hereinafter and then stored in the memory 51 respectively in Step S110 or Step S133 and feeds it as a solenoid current command Icmd to the control valve driving circuit 54 (FIG. 9).

Where the memory 51 has not yet stored any learnt value Ixref, it suffices to have a numerical value resembling the learnt value stored in advance in the memory 51 and read out as a learnt value Ixref(n).

Thereafter, the processing returns to the main program. As its result, the control valve 30 has the opening angle controlled by the control valve driving circuit 54 and the solenoid 16 in accordance with the command Icmd.

Step S104—This step calculates the value Ifb(n) as described above with reference to FIG. 7.

Step S105—This step judges whether the vehicle speed exceeds a prescribed value $V_1$ or not. Specifically, this judgement is accomplished by the detection of the input signal from the RPM counter 2, for example. The processing proceeds to Step S114 when the vehicle speed exceeds $V_1$ or to Step S106 when the vehicle speed is lower than $V_1$.

Step S106—This step judges whether the power steering is operating or not in accordance with the signal from the PS sensor 1. The processing proceeds to Step S114 when the judgement is affirmative or to Step S107 when the judgement is negative.

Step S107—This step judges whether the air conditioner is operating or not, in accordance with the input signal from the AC sensor 3. The processing jumps to Step S114 when the judgement is affirmative or to Step S108 when the judgement is negative.

Step S108—This step judges whether or not the reciprocal (period) of the number of rotations detected by the RPM counter 2 or an equivalent amount Me falls in the range of the reciprocals of the upper limit and the lower limit of the prescribed region set on the basis of the target number of idling rotations or equivalent values (Mixh~Mixl).

The processing jumps to Step S114 when the judgement is negative. When the judgement is affirmative, since the learning described afterward is available and the learnt values Ixref and Pbref are both obtainable adequately, and the processing proceeds to Step S109.

Step S109—This step calculates the learnt value Ixref(n), which is defined by the following formula (3).

$$Ixref(n)=Iai(n)\times Ccrr/m+Ixref(n-1)\times(m-Ccrr)/m \quad (3)$$

The term Iai(n) in the formula (3) is the numerical value calculated in Step S45 of FIG. 7 already described with reference to the first embodiment of the present invention and the term Ixref(n−1) is the learnt value Ixref obtained in the preceding cycle. The terms m and Ccrr are positive numerals that are set arbitrarily and have the relation of m>Ccrr.

Step S110—This step stores in memory 51 the value Ixref calculated in step S109.

Step S111—This step calculates the intake manifold pressure Pbi existing while the automatic transmission is in the N range, in accordance with the following formula (4).

$$Pbi=Pba(n)-Pbe_1+Pbpa \quad (4)$$

In the formula (4), the term Pba(n) denotes the intake manifold pressure of the internal combustion engine detected by the Pba sensor 8, and the term $Pbe_1$ denotes the subtraction correction term for the intake manifold pressure corresponding to the field current (or the magnitude of electric load) of the AC generator detected by known means. Specifically, the numerical value of the subtraction correction term $Pbe_1$ for the intake manifold pressure is fixed on the basis of the E1~$Pbe_1$ table stored in the memory 51 as the function of the field current.

Figure 11:
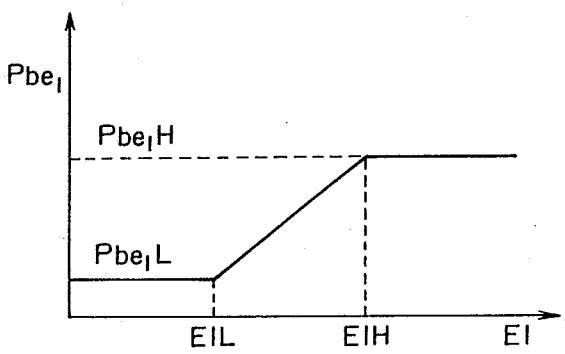
FIG. 11 is a graph showing a typical relation between the magnitude of electric load E1 and the intake manifold depression substraction correction term $Pbe_1$.

FIG. 11 is a graph showing the relation between the magnitude of electric load E1 and the subtraction correction term $Pbe_1$ for the intake manifold pressure. The value of $Pbe_1$ in the E1~$Pbe_1$ table shown here by way of example linearly increases from $Pbe_1$ L to $Pbe_1$ H in the prescribed range(E1L~E1H) of the magnitude of electric load E1.

The term Pbpa in the formula (4) is the addition correction term for the intake manifold pressure corresponding to the atmospheric pressure Pa detected by known means. The numerical value of this term is specifically fixed by the Pa~Pbpa table stored in the memory 51 as the function of the atmospheric pressure.

Figure 12:
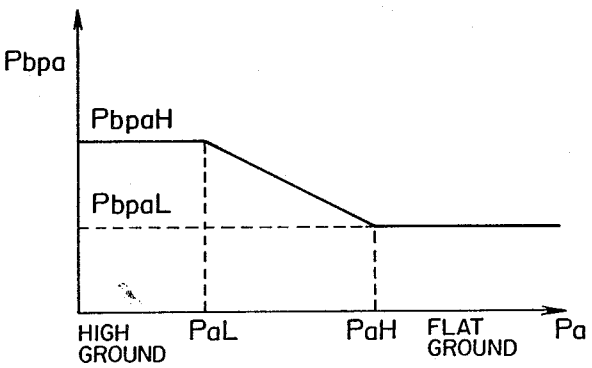
FIG. 12 is a graph showing a typical relation between the atmospheric pressure Pa and the intake manifold depression subtraction correction term Pbpa.

FIG. 12 is a graph showing the relation between the atmospheric pressure Pa and the addition correction term Pbpa for the intake manifold pressure. The value of Pbpa in the Pa~Pbpa table shown here by way of example linearly decreases from Pbpa H to Pbpa L in the prescribed range of the atmospheric pressure Pa (PaL~PaH).

As is clear from the foregoing description, the term Pbi in the present embodiment denotes the intake manifold pressure which exists when the internal combustion engine located on flat ground (at sea level) is in a no-load condition and the automatic transmission is in the N range.

Step S112—This step calculates the learnt value Pbref(n) of the intake manifold pressure existing when the automatic transmission is in the N range in accordance with the following formula (5).

$$Pbref(n)=Pbi\times Cpbref/m+Pbref(n-1)\times(m-Cpbref)/m \quad (5)$$

When the memory 51 has not yet stored the learnt value Pbref in Step S113 which is described afterward, it suffices to have a numerical value resembling the learnt value stored in advance in the memory 51 and read out as a learnt value Pbref(n−1) of the preceding cycle.

The terms m and Cpbref in the formula (5) given above are positive numerals that are set arbitrarily and have the relation of m>Cpbref.

Step S113—This step stores in the memory 51 the learnt value Pbref of the intake manifold pressure calculated in Step S112 when the automatic transmission is in the N range.

Step S114—This step feeds the value Ifb(n) calculated in Step 104 as the solenoid current command Icmd to the control valve driving circuit 54. Thereafter, the processing returns to the main program.

As the result, the control valve 30 (FIG. 2) has its opening angle controlled by the control valve driving circuit 54 and the solenoid 16 in accordance with the command Icmd.

When the processing of FIG. 10 has jumped from Step S106 or Step S107 to Step S114, the feedback control of the control valve 30 can be effected more adequately by effecting the calculation of the value of command Icmd by adding the prescribed value corresponding to the engine load as a correction term to the value Ifb(n).

In Step S101, the processing proceeds to Step S115 when the automatic transmission is in the D range. This Step S115 judges whether or not the prescribed time (Tar seconds) has elapsed after the automatic transmission enters the D range. The processing proceeds to Step S117 when the judgement is affirmative or to Step S116 when the judgement is negative.

Step S116—This step sets the addition correction term Iat in the formula (1) described above, as the constant value Iato.

Step S117—This step judges whether or not the speed of rotation Ne exceeds the prescribed number of rotations Nzo. The processing proceeds to Step S122 when the judgement is negative or to Step S118 when the judgement is affirmative.

Step S118—This step sets the value of the addition coefficient correction term Iat in the formula (1) at 0.

Step S119—This step judges whether or not the control valve 30 (FIG. 8) is in the feedback mode, similarly to Step S102. The processing proceeds to Step S121 when the judgement is affirmative or to Step S120 when the judgement is negative.

Step S120—This step adds the value Iat set in Step S116, Step S118, or Step 123 (namely the constant value Iato or 0) to the latest learnt value Ixref(n) stored in Step S110 or Step S133 yet to be described and feeds the sum as the value of the solenoid current command Icmd to the control valve driving circuit 54.

Then, the processing returns to the main program. As the result, the control valve 30 (FIG. 3) has the degree of its opening controlled by the control valve driving circuit 54 and the solenoid 16 in accordance with the command Icmd.

Step S121—This step, similarly to Step S104, calculate the value Ifb(n). Thereafter, the processing proceeds to Step S134.

Step S122—This step, similarly to Step 102 and Step S119, judges whether or not the control valve 30 is in the feedback control mode. The processing proceeds to Step S124 when the judgement is affirmative or to Step S123 when the judgement is negative.

Step S123—This step sets the addition correction term Iat in the formula (1) mentioned above at the constant value of Iato. Thereafter, the processing proceeds to Step S120.

Step S124—This step calcualtes the differential pressure ΔP bat between the intake manifold pressure Pba(n) existing while the automatic transmission is in the D range and the learnt value Pbref of the intake manifold pressure existing while the automatic transmission is in the N range, in accordance with the following formula (6).

$$\Delta Pbat = Pba(n) - Pbref \quad (6)$$

When this embodiment is modified so that the differential pressure ΔPbat is calculated in accordance with the following formula (7), the differential pressure to be obtained will be the difference between the intake manifold depression existing when the internal combustion engine located on flat ground is in the no-load state and the automatic transmission is in the D range and the learnt value Pbref is as mentioned above.

$$\Delta Pbat = Pba(n) - Pbref - Pbe_1 - Pbps - Pbac + Pbpa \quad (7)$$

The terms $Pbe_1$ and Pbpa in the formula (7) are the same correction terms as those of the formula (4), and the terms Pbps and Pbac are subtraction correction terms for decreasing the additions made respectively to the intake manifold depression when the power steering and the air conditioner are operating.

Step S125—This seep looks up the ΔPbat ~ Kat table stored in advance in the memory on the basis of the differential pressure ΔPbat mentioned above and fixes the coefficient Kat.

Figure 13:
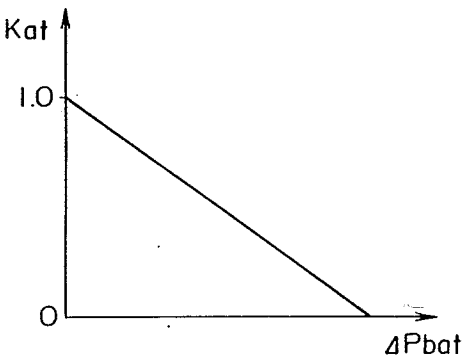
FIG. 13 is a graph showing a typical relation between the differential pressure ΔPbat and the coefficient Kat.

FIG. 13 is a graph showing the relation between the differential pressure ΔPbat and the coefficient Kat previously described in reference to FIG. 7. As is clear from FIG. 13, the value of Kat is "1.0" and ΔPbat is 0 under standard operating conditions of the engine, and proportionately decreases and approaches 0 as ΔPbat increases.

Step S126—This step multiplies the fixed value Iato set in Step S116 or Step S123 by the coefficient Kat mentioned above and defines the resulting product as the addition correction term Iat in the formula (1).

Here, Iato may be a fixed value as mentioned above. Since the magnitude of the load exerted by the automatic transmission on the internal combustion engine varies with the temperature of the hydraulic oil used in the automatic transmission, it is desirable for more accurate calculation of Iat to vary Iato in accordance with the temperature of the hydraulic oil.

Figure 14:
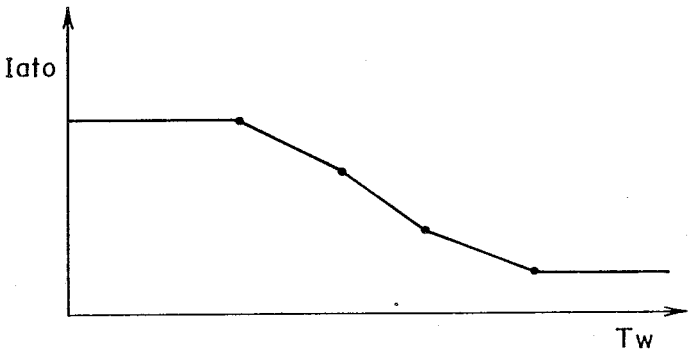
FIG. 14 is a graph showing a typical relation between the temperature of engine cooling water Tw and the fixed value Iato.

In the present embodiment, the numerical value of Iato is fixed by detecting the temperature of the engine cooling water (Tw) with a suitable known means such as, for example, the engine temperature sensor 4 of FIG. 2, using this temperature as representing the temperature of the hydraulic oil, and looking up the Tw—Iato table stored in advance in the memory 51 with the value Tw as a parameter. FIG. 14 is a graph showing a typical relation between the temperature Tw of the engine cooling water and the value Iato.

Step S127—This step calculates the value Ifb(n) similarly to Step S104 and Step S121, by the arithmetic operation.

Step S128 ~ Step S131—These steps effect the same judgements as made in Step S105 through Step S108. The processing jumps over Step S132 and Step S133 yet to be described and proceeds to Step S134 when at least one of the judgements in the Steps S128 through S130 is affirmative or the judgement in the Step S131 is negative. Otherwise, the processing proceeds to Step S132.

Step S132—This step, similarly to Step S109, calculates the learnt value Lxref(n) in accordance with the formula (3).

Step S133—This step stores in the memory 51 the learnt value Ixref calculated as described above.

Step S134—This step adds the value Iat set in Step S116, Step S118, or Step S126 to the value Ifb(n) calculated in Step S121 or Step 127 and feeds the resulting sum as a solenoid current command Icmd to the control valve driving circuit 54.

Then, the processing returns to the main program. As the result, the control valve 30 (FIG. 8) has the degree of its opening controlled by the control valve driving circuit 54 and the solenoid 16 in accordance with the value Icmd.

As is clear from the foregoing description, the second embodiment of this invention calculates the learnt value Pbref based on the intake manifold depression in the no-load state existing when the internal combustion engine is idling under feedback control and, when the engine in the same operating state assumes a loaded state, fixes the addition correction term of the formula (1) based on the difference between the intake manifold depression during the exertion of load and the learnt value Pbref mentioned above.

As the result, the addition correction term is made to assume an adequate value. In other words, this term is not allowed to assume an excessively large value and, therefore, the feedback control term Ifb(n) of the formula (1) has no possibility of assuming an excessively small value.

As is clear from the description above, this invention brings about the following effects.

(1) The feedback control term Ifb(n) which defines the value Icmd of the solenoid current command is not allowed to assume an excessively small value even when the internal combustion engine in process of idle operation under feedback control is placed in a loaded state. When the load is suddenly increased, therefore, this increase in the load can be corrected by the term Ifb(n). As the result, the possibility of the number of rotations being decreased to a great extent or the possibility of the engine stalling can be prevented.

(2) The feedback control term Ifb(n) which defines the value Icmd of the solenoid current command is stabilized and is not allowed to assume an excessively small value even when the internal combustion engine is in process of idle operation under feedback control and the automatic transmission is in the D range. When the AT load is suddenly increased, the increase in the load can be corrected by the term Ifb(n). As the result, the possibility of the number of rotations being decreased to a great extent or the possibility of the engine assuming the state of stall is precluded.

What is claimed is:

1. A method for controlling the idling rotational speed of an internal combustion engine mounted on a vehicle, said vehicle having an automatic transmission that is coupled to said engine, said internal combustion engine being provided with a control valve adapted to control the amount of inlet air to said engine during an idling operation thereof by allowing the degree of opening of said control valve to be controlled proportionately to the value of a control valve command obtained on the basis of the sum of a feedback control term and an addition correction term conforming to the load of said automatic transmission on said engine, the method comprising:

sensing the current rotational speed of the engine, determining a target number of idling rotations of the engine, calculating the deviation of said current rotational speed from said target number of idling rotations, calculating said feedback control term in accordance with said deviation of the current rotational speed from said target number of idling rotations, sensing whether said automatic transmission is in its drive range or in its neutral range, and calculating the addition correction term when the automatic transmission is in its drive range, the addition correction term consisting of the product of a predetermined value fixed for a standard load of the automatic transmission on the engine and a correction value obtained on the basis of the difference between the standard operating state and an actual operating state of the internal combustion engine at the time said control valve command is generated, said correction value being predetermined as a function of the deviation of the actual vehicle speed from the standard value thereof.

2. The method of claim 1 wherein said correction value is predetermined as a function of both the deviation of the actual vehicle speed from the standard value thereof and the deviation of the actual engine temperature from the standard value thereof.

3. The method of claim 1 wherein said correction value is predetermined as a function of both the deviation of the actual vehicle speed from the standard value thereof and the deviation of the actual engine rotational speed from the standard value thereof.

4. The method of claim 1 wherein said correction value is predetermined as a joint function of the deviation of the actual vehicle speed from the standard value thereof, the deviation of the actual engine temperature from the standard value thereof, and the deviation of the actual engine rotational speed from the standard value thereof.

* * * * *